US005125212A

United States Patent [19]

Smyth

[11] Patent Number: 5,125,212

[45] Date of Patent: Jun. 30, 1992

[54] METHOD OF MAKING PULL-TABS FOR CANS

[75] Inventor: Thomas F. Smyth, Wayne, Pa.

[73] Assignee: American Solder & Flux Co., Inc., Paoli, Pa.

[21] Appl. No.: 647,916

[22] Filed: Jan. 30, 1991

[51] Int. Cl.[5] ..... B65B 61/18; B21D 51/28

[52] U.S. Cl. ..... 53/412; 53/133.8; 72/42

[58] Field of Search ..... 53/412, 133.7, 133.8, 53/133.3, 133.5; 413/18, 17, 16, 15, 12; 72/42, 41

[56] References Cited

U.S. PATENT DOCUMENTS

| | | | |
|---|---|---|---|
| 3,868,919 | 3/1975 | Schrecker et al. | 413/18 X |
| 3,884,382 | 5/1975 | Ball | 53/412 X |
| 4,106,422 | 8/1978 | Buhrke | 413/17 |
| 4,848,623 | 7/1989 | Saunders et al. | 413/17 X |
| 4,950,415 | 8/1990 | Malito | 72/42 X |
| 4,978,465 | 12/1990 | Sturwold | 72/42 X |

FOREIGN PATENT DOCUMENTS

| | | | |
|---|---|---|---|
| 3207198 | 9/1983 | Fed. Rep. of Germany | 53/412 |

*Primary Examiner*—James F. Coan
*Attorney, Agent, or Firm*—John F. A. Earley; John F. A. Earley, III

[57] ABSTRACT

A method of making pull-tabs for the ends of cans of soda or the like in which a strip of aluminum having a top surface and a bottom surface is fed into a progressive die, a substantially non-volatile lubricant composition is deposited onto the top and bottom surfaces of the strip as it is being fed into the die so as to protect the die from excessive wear during subsequent stamping operations, pull-tabs are stamped out in a progressive fashion in the progressive die, and the amount of lubricant composition deposited is such that it is substantially completely used up so that the tabs are substantially free of lubricant composition when they leave the die, whereby the emission into the atmosphere of volatile organic contents is substantially reduced or eliminated, and unwanted transfer of lubricant from a pull-tab to a can end stacked above it is substantially reduced to avoid contaminating the can end. The preferred lubricant composition is about, by weight, 20 parts butyl stearate and 80 parts mineral oil.

12 Claims, No Drawings

METHOD OF MAKING PULL-TABS FOR CANS

BACKGROUND OF THE INVENTION

1. Field of the Invention

This invention relates to pull-tabs for cans of soda and the like, and more particularly concerns a method of making pull-tabs for cans and affixing them to the ends of cans without any unwanted transfer of lubricant from the pull-tabs to the interior of a can end stacked above it, and to substantially reducing the emission into the atmosphere of volatile organic contents (VOCs).

2. Description of the Prior Art

It is conventional in the forming of pull-tabs for cans to take a strip of aluminum and feed it into a progressive die press. There may be seventeen steps in the die press that are taken progressively, with the first die making a little indentation in the strip, the second die making a further indentation, and so on so that by the time the strip gets to the seventeenth step, it has formed a pull-tab that it is then riveted onto the exterior of a can end. This progressive die press operates at a high rate of speed, as anywhere from 550 to 575 strokes per minute. Since the die press stresses the aluminum strip, a lubricant is required to protect the tooling in the die press which is very expensive. These presses run twenty-four hours a day, seven days a week, 365 days a year. When a die press has to be shut down to replace the tooling because it has become dull, the down time becomes expensive. Accordingly, operators of such die presses are always looking for a lubricant that gives them the maximum amount of efficiency and the least amount of down time per year.

A conventional lubricant composition for these presses may be delivered in tank trucks containing 7000 gallons of the lubricant composition, and a delivery may be made every five weeks to just one plant. However, this conventional lubricant composition comprises 6300 gallons of solvent and 700 gallons of lubricant, and so 6300 gallons of the solvent evaporates from the liquid into the atmosphere when the lubricant composition is being used. Since the solvent is a hydrocarbon, this contaminates the atmosphere, and the government is trying to reduce the contamination under the Clean Air Act by limiting the amount of volatile organic contents (VOCs) that go into the atmosphere. The government has put a cap on all plants that emit VOCs so that they cannot release more than a certain amount of VOCs per year. This limitation on VOCs is not limited to conventional lubricants used in die presses, but also includes any other VOC emissions that may come from other substances, such as paint.

Accordingly, many engineers and plant superintendents have been working on the problem and have been looking for a lubricant composition that would lubricate the dies and yet not release unwanted hydrocarbons into the atmosphere. The conventional lubricant formula includes a butyl stearate in a solvent such as alcohol, and the alcohol evaporates and releases the unwanted VOCs into the atmosphere.

SUMMARY OF THE INVENTION

Accordingly, it is an object of this invention to provide a method of making pull-tabs for cans, and a lubricant composition which lubricates the dies press that makes the pull-tabs but does not release unwanted VOCs into the atmosphere and contaminate it.

It is another object of this invention to provide such a method and lubricant composition that does not contaminate cans by transferring unwanted lubricant composition from the pull-tab of a can end to the interior of a can end stacked above it.

The objects of this invention are accomplished by providing a lubricant composition that does not have a volatile solvent that releases into the atmosphere, but by instead providing a lubricant composition comprising butyl stearate and mineral oil, which is non-volatile. Enough lubricant composition is provided to coat the strip from which the pull-tab is to be made to protect the components of the die press, but only enough is provided so that the lubricant is used up during the die pressing operation so that substantially no lubricant remains on the pull tab to prevent transfer of lubricant composition from the pull-tab to the interior of a can end.

DETAILED DESCRIPTION OF THE INVENTION

In the method of making pull-tabs for the ends of cans of soda or the like in accordance with this invention, a strip of metal having a top surface and a bottom surface is fed into a progressive die, and a substantially non-volatile lubricant composition is deposited onto the top and bottom surfaces of the strip as it is being fed into the die so as to protect the die from excessive wear during subsequent stamping operations. Then, pull-tabs are stamped out of the strip in progressive steps in the die, using up the deposited little or none remains on the pull-tabs when the stamping steps are finished.

The amount of lubricant composition deposited on the strip is such that it is substantially used up when the pull-tabs leave the die so that the pull-tabs are substantially free of lubricant composition when they leave the die.

Each pull-tab is riveted to the outside surface of a can end to form a tabbed can end, and the tabbed can ends are stacked in a sleeve one on top of the other with the interior of an upper can end being in contact with the pull-tab of a lower can end.

The transfer of lubricant from the pull-tab to the interior of an upper can end is limited so that there is substantially no lubricant composition transferred to the interior of the can end that might contaminate the contents of a later formed can that includes the can end.

The preferred lubricant composition of the invention is about, by weight, 20 parts butyl stearate and 80 parts mineral oil.

Because the mineral oil carrier of the lubricant composition is not volatile, it does not release VOCs into the atmosphere to any great extent, especially as compared to the release of VOCs into the atmosphere from conventional lubricant compositions having hydrocarbons as a solvent.

The method of the invention further includes the steps of forming a can cup portion having a bottom wall and a side wall extending upwardly therefrom with an open top. This is generally a two step operation and the same non-volatile composition is used. The can cup portion is filled then with contents which may be soda, or beer, or the like, and a tabbed can end is attached to the open top to close the can and seal its contents.

The preferred metal strip is aluminum as is the can cup portion, but they may be steel, or tin or other materials used in making cans.

The preferred lubricant composition of the invention comprises, by weight, about 20 parts of butyl stearate to 80 parts of mineral oil. This preferred lubricant composition may be obtained from the Force Chemicals Division of American Solder & Flux Co., Inc., at 28 Industrial Boulevard, Paoli, Pennsylvania, 19301-0947, where it is available under the trademark AMCO 4882 which is described as an environmentally designed lubricating oil for aluminum and steel blanking without sacrificing the dimensional accuracy of the blanking process. It is specifically formulated to meet the Clean Air Act of 1990 by minimizing VOC (volatile organic content) values, without compromising die life, or lubricity.

The preferred butyl stearate in the lubricating composition is available under the trademark EMEREST 2326 from Emery Chemical.

The preferred mineral oil is available under the trademark DRAKEOL 15, and is obtainable from Penreco, a division of Pennzoil Products Company of Butler, Pennsylvania.

I claim:

1. A method of making pull-tabs for the ends of cans of soda or the like, comprising the steps of feeding a strip of metal having a top surface and a bottom surface into a progressive die, depositing a substantially non-volatile lubricant composition onto the top and bottom surfaces of the strip as it is being fed into the die so as to protect the die from excessive wear during subsequent stamping operations, stamping out the tabs in progressive steps in the die, using up the deposited lubricant composition during the stamping steps, the amount of lubricant deposited being such that it is substantially completely used up during the stamping steps so that the tabs are substantially free of lubricant when they leave the die, riveting each of the tabs to the outside surface of a can end to form a tabbed can end, stacking the tabbed can ends in a sleeve one on top of another with the interior of an upper can end being in contact with the tab of a lower can end, and limiting the transfer of lubricant from the tab to the interior of the upper can end so that there is substantially no lubricant transferred to the interior of the can end that might contaminate the contents of a later formed can that includes the can end, accomplishing said limiting of the transfer of lubricant from the tab to the interior of the upper can end by providing substantially no lubricant on said tabs, whereby the emission into the atmosphere of volatile organic contents (VOCs) is substantially reduced or eliminated and there is substantially no transfer of lubricant from a pull-tab to a can end stacked above it, forming a can cup portion having a bottom wall and a side wall extending upwardly therefrom with an open top, filling the can cup portion with contents, and attaching a tabbed end to the open top to close the can, said lubricant composition being by weight about 20 parts butyl stearate and 80 parts mineral oil.

2. A can made in accordance with the method of claim 1.

3. A method of making pull-tabs for the ends of cans of soda or the like, comprising the steps of feeding a strip of metal having a top surface and a bottom surface into a progressive die, depositing a substantially non-volatile lubricant composition onto the top and bottom surfaces of the strip as it is being fed into the die so as to protect the die from excessive wear during subsequent stamping operations, stamping out the tabs in progressive steps in the die, using up the deposited lubricant composition during the stamping steps, the amount of lubricant deposited being such that it is substantially completely used up during the stamping steps so that the tabs are substantially free of lubricant when they leave the die, riveting each of the tabs to the outside surface of a can end to form a tabbed can end, stacking the tabbed can ends in a sleeve one on top of another with the interior of an upper can end being in contact with the tab of a lower can end, and limiting the transfer of lubricant from the tab to the interior of the upper can end so that there is substantially no lubricant transferred to the interior of the can end that might contaminate the contents of a later formed can that includes the can end, accomplishing said limiting of the transfer of lubricant from the tab to the interior of the upper can end by providing substantially no lubricant on said tabs, whereby the emission into the atmosphere of volatile organic contents (VOCs) is substantially reduced or eliminated and there is substantially no transfer of lubricant from a pull-tab to a can end stacked above it, forming a can cup portion having a bottom wall and a side wall extending upwardly therefrom with an open top, filling the can cup portion with contents, and attaching a tabbed end to the open top to close the can, said lubricant composition being by weight about 20 parts butyl stearate and 80 parts mineral oil, said metal being aluminum.

4. A method of making pull-tabs for the ends of cans of soda or the like, comprising the steps of feeding a strip of metal having a top surface and a bottom surface into a progressive die, depositing a substantially non-volatile lubricant composition onto the top and bottom surfaces of the strip as it is being fed into the die so as to protect the die from excessive wear during subsequent stamping operations, stamping out the tabs in progressive steps in the die, using up the deposited lubricant composition during the stamping steps, the amount of lubricant deposited being such that it is substantially completely used up during the stamping steps so that the tabs are substantially free of lubricant when they leave the die, riveting each of the tabs to the outside surface of a can end to form a tabbed can end, stacking the tabbed can ends in a sleeve one on top of another with the interior of an upper can end being in contact with the tab of a lower can end, and limiting the transfer of lubricant from the tab to the interior of the upper can end so that there is substantially no lubricant transferred to the interior of the can end that might contaminate the contents of a later formed can that includes the can end, accomplishing said limiting of the transfer of lubricant from the tab to the interior of the upper can end by providing substantially no lubricant on said tabs, whereby the emission into the atmosphere of volatile organic contents (VOCs) is substantially reduced or eliminated and there is substantially no transfer of lubricant from a pull-tab to a can end stacked above it, forming a can cup portion having a bottom wall and a side wall extending upwardly therefrom with an open top, filling the can cup portion with contents, and attaching a tabbed end to the open top to close the can, said lubricant composition being by weight about 20 parts butyl stearate and 80 parts mineral oil, said metal being steel.

5. A method of making pull-tabs for the ends of cans of soda or the like, comprising the steps of feeding a strip of metal having a top surface and a bottom surface into a progressive die, depositing a substantially non-volatile lubricant composition onto the top and bottom surfaces of the strip as it is being fed into the die so as to protect the die from excessive wear during subsequent stamping operations, stamping out the tabs in progressive steps in the die, using up the deposited lubricant composition during the stamping steps, the amount of lubricant deposited being such that it is substantially completely used up during the stamping steps so that the tabs are substantially free of lubricant when they leave the die, riveting each of the tabs to the outside surface of a can end to form a tabbed can end, stacking the tabbed can ends in a sleeve one on top of another with the interior of an upper can end being in contact with the tab of a lower can end, and limiting the transfer of lubricant from the tab to the interior of the upper can end so that there is substantially no lubricant transferred to the interior of the can end that might contaminate the contents of a later formed can that includes the can end, accomplishing said limiting of the transfer of lubricant from the tab to the interior of the upper can end by providing substantially no lubricant on said tabs, whereby the emission into the atmosphere of volatile organic contents (VOCs) is substantially reduced or eliminated and there is substantially no transfer of lubricant from a pull-tab to a can end stacked above it.

6. The method of claim 5, including the further steps of forming a can cup portion having a bottom wall and a side wall extending upwardly therefrom with an open top, filling the can cup portion with contents, and attaching a tabbed end to the open top to close the can.

7. The method of claim 5, said lubricant composition being by weight about 20 parts butyl stearate and 80 parts mineral oil.

8. The method of claim 5, said metal being aluminum.

9. The method of claim 5, said metal being steel.

10. A pull-tab and can end made in accordance with the method of claim 1.

11. A can made in accordance with the method of claim 2.

12. A pull-tab and can end made in accordance with the method of claim 3.

* * * * *